US006332975B1

(12) United States Patent
Abdel-Halim et al.

(10) Patent No.: US 6,332,975 B1
(45) Date of Patent: Dec. 25, 2001

(54) ANODE GRADE COKE PRODUCTION

(75) Inventors: Tayseer Abdel-Halim, The Woodlands; Raymond H. Floyd, Katy; Jim Y. Low, Missouri City; Jon C. Moretta; Michael A. Silverman, both of Houston; Harold D. Sloan, Tomball, all of TX (US)

(73) Assignee: Kellogg Brown & Root, Inc., Houston, TX (US)

( * ) Notice: Subject to any disclaimer, the term of this patent is extended or adjusted under 35 U.S.C. 154(b) by 0 days.

(21) Appl. No.: 09/452,069

(22) Filed: Nov. 30, 1999

(51) Int. Cl.[7] ..... C10G 9/14; C10B 57/02

(52) U.S. Cl. ..... 208/131; 208/50; 208/86; 208/87; 208/89; 208/132

(58) Field of Search ..... 208/50, 131, 87, 208/51, 56, 57, 132, 86, 89

(56) References Cited

U.S. PATENT DOCUMENTS 4,919,793 * 4/1990 Mallari ..... 208/131
4,940,529 7/1990 Beaton et al. .
5,013,427 5/1991 Mosby et al. .
5,124,027 6/1992 Beaton et al. .
5,228,978 7/1993 Taylor et al. .
5,242,578 9/1993 Taylor et al. .
5,258,117 11/1993 Kolstad et al. .
5,286,371 * 2/1994 Goyal et al. ..... 208/131
5,312,543 5/1994 Taylor et al. .
5,431,812 * 7/1995 Abraham ..... 208/131

* cited by examiner

*Primary Examiner*—Bekir L. Yildirim
(74) *Attorney, Agent, or Firm*—Kellogg Brown & Root, Inc

(57) ABSTRACT

The invention is a process for making anode grade coke which comprises solvent deasphalting a residue feedstock to obtain an essentially asphaltene-free, resin-containing stream and coking the resin-containing stream in a delayed coker to make anode coke. The solvent deasphalting can make a deasphalted oil stream containing resin or separate deasphalted oil and resin streams. There can be hydrotreating of (1) a minor portion of the residue feedstock wherein the hydrotreated residue is fed to the delayed coker with the resin-containing stream, (2) the resin-containing stream wherein the hydrotreated resin stream is fed to the delayed coker, or (3) a major portion of the residue feedstock wherein the hydrotreated residue is fed to the solvent deasphalting unit.

31 Claims, 5 Drawing Sheets

ANODE GRADE COKE PRODUCTION

FIELD OF THE INVENTION

The present invention relates generally to a method for making anode grade coke and particularly to heating in a delayed coker vessel a resin-containing stream obtained by solvent deasphalting a petroleum residue feedstock containing sulfur and metal contaminants.

BACKGROUND OF THE INVENTION

The economics of petroleum production and refining are requiring that more usable materials be obtained from petroleum residues of ever worsening characteristics, primarily sulfur content, metal content and asphaltene content of the petroleum residues, resulting from the atmospheric and vacuum distillation of petroleum feedstocks. The distillation of the petroleum feedstock tends to concentrate the contaminants into the petroleum residue.

Common ways of improving the yield of distillate products and disposing of the residue have involved hydrotreating. Hydrotreating involves reacting the petroleum residue with hydrogen in the presence of a catalyst to convert the petroleum residue into a higher proportion of more valuable lower-boiling products. The residue remaining after the lower-boiling products are removed from the hydrotreater effluent generally has a lower sulfur and metal content.

Another process commonly used to treat petroleum residue is delayed coking. In this process, the petroleum residue is heated and subjected to destructive thermal cracking to produce valuable lower-boiling petroleum distillate products, and forming a solid carbonaceous residue known as coke. Coke with a high sulfur and/or metal content is generally subject to combustion as a fuel. "Fuel grade coke" is not generally suitable for other purposes.

Higher quality coke grades such as anode grade coke generally have lower sulfur and metal content. For example, anode grade coke generally has a sulfur content less than 3 weight percent, a nickel content less than 200 ppm, a vanadium content less than 350 ppm and a total metals content less than 500 ppm. In addition, anode grade coke which is suitable for use as making a carbon anode which can be used in aluminum manufacture, for example, must also have an HGI grindablility index greater than 70, a bulk density of at least 50 lbs/ft$^3$, and a volatile carbonaceous material content of less than 10 or 12 weight percent. It is more desirable to produce anode grade coke since this is a higher value product than fuel grade coke.

Particularly with high sulfur, high metals residues, one approach has been suggested to hydrotreat the residue which removes the sulfur and metal so that the coke obtained by destructive thermal cracking of is the hydrotreated residue is within specifications for anode grade coke. Unfortunately, however, it is known that hydrotreating of the petroleum residue feedstock affects the physical characteristics of the coke, which can make the coke unsuitable for the anode manufacturing process. Therefore, for the production of anode grade coke, feedstocks have been historically limited to virgin residues with inherently low sulfur and metals content. Petroleum residues are generally comprised of saturate, aromatic, resin and asphaltene fractions. Hydrotreating a petroleum residue is known to convert a portion of the resin fraction to saturates. The data below in Table 1 are based on the feed and product from a commercial hydrotreating unit and illustrate this change:

TABLE 1

| | Resin fraction (wt %) | Saturates fraction (wt %) |
|---|---|---|
| Virgin petroleum residue | 35 | 14 |
| Hydrotreated residue | 13 | 33 |

It is generally accepted that the type of change in composition illustrated above can make the hydrotreated residue unsuitable for anode grade coke production.

It is also known to subject petroleum residue fractions to solvent extraction to separate the residue fraction into a deasphalted oil fraction and an asphaltene fraction, and sometimes into a third resin fraction. It has been known to hydrotreat and/or catalytically crack the deasphalted oil and/or resin fractions, and treat the asphaltene fraction in a delayed coker. However, as far as applicants are aware, no one has previously tried to improve the quality of coke produced in the delayed coker by feeding the resin-containing fraction from the solvent deasphalting of the petroleum residue to a delayed coker unit.

U.S. Pat. No. 5,013,427 to Mosby et al. discloses hydrotreating a petroleum residue feed with a resin fraction from a solvent extraction unit together in a residue hydrotreating unit, feeding a first portion of the residue hydrotreating unit bottoms fraction to the solvent extraction unit, and a second portion of the hydrotreated residue to a coker unit. Similar disclosures are found in U.S. Pat. Nos. 4,940,529 to Beaton et al.; 5,124,027 to Beaton et al.; 5,228,978 to Taylor et al.; 5,242,578 to Taylor et al.; 5,258,117 to Kolstad et al.; and 5,312,543 to Taylor et al.

SUMMARY OF THE INVENTION

The present invention involves the discovery that the quality of coke made from a high sulfur and/or high metals petroleum residue feedstock can be upgraded by solvent deasphalting and heating a resin-containing stream obtained thereby in a delayed coker to make anode grade coke. While the sulfur and metals levels of the residue may be reduced by hydrotreating and/or solvent deasphalting as appropriate for producing coke meeting anode grade coke specifications for sulfur and metals, we have found that other anode grade coke specifications such as volatile carbonaceous material content, bulk density and grindability are not easily met. We believe the aromatic content of the resin fed to the coker in our invention results in the improved properties of the coke obtained by coking the resin-containing stream. In the process according to our invention, the residue feedstock is solvent deasphalted to form a deasphalted oil stream, an optional but preferred separate resin stream, and an asphaltene-rich stream, and the resin-containing stream is coked in a delayed coker, preferably with hydrotreating of (1) a minor portion of the residue feedstock wherein the hydrotreated residue is fed to the delayed coker with the resin-containing stream, (2) the resin-containing stream wherein the resin-containing stream is fed to the delayed coker, or (3) a major portion of the residue feedstock wherein the hydrotreated residue is fed to the solvent deasphalting unit.

Broadly, the present invention provides a process for preparing anode grade coke from a petroleum residue feedstock containing sulfur and metal contaminants, comprising: (1) solvent deasphalting the residue feedstock to produce (a) a deasphalted oil stream, a resin stream essentially free of asphaltenes and an asphaltene-rich stream, or (b) a deasphalted oil stream comprising resin and an asphaltene rich stream; (2) feeding a process stream comprising the resin stream or the resin comprising deasphalted oil stream directly to a delayed coker; and (3) heating the process stream in the delayed coker under delayed coking conditions to form a batch of the anode grade coke. The process stream fed to the delayed coker can be essentially free of hydrotreated material.

In another embodiment, the present invention provides a process for preparing anode grade coke from a petroleum residue feedstock containing sulfur and metal contaminants. The process includes the steps of: (1) hydrotreating a first process stream consisting essentially of a first portion of the residue feedstock to produce a hydrotreated residue stream of reduced sulfur and metal content; (2) solvent deasphalting a second portion of the residue feedstock to produce a deasphalted oil stream, a resin stream essentially free of asphaltenes and an asphaltene-rich stream; (3) feeding the hydrotreated residue stream together with a second process stream comprising the resin stream to a delayed coker; and (4) heating the hydrotreated residue stream and the second process stream in the delayed coker under delayed coking conditions to form a batch of the anode grade coke. The second process stream can further comprise a minor portion of the deasphalted oil stream and/or a minor portion of the asphaltene-rich stream. A third process stream consisting essentially of the asphaltene-rich stream can be fed to the delayed coker and heated in the delayed coker under delayed coking conditions to form a batch of fuel grade coke, between batches of anode coke formation. At least a portion of the asphaltene-rich stream can be blended with cutterstock to form a fuel oil stream.

In another embodiment, the present invention provides a process for preparing anode grade coke from a petroleum residue feedstock containing sulfur and metal contaminants, comprising: (1) hydrotreating a first process stream consisting essentially of the residue feedstock to produce a hydrotreated residue stream of reduced sulfur and metal content; (2) solvent deasphalting a second process stream comprising the hydrotreated residue stream to produce a deasphalted oil stream, a resin stream essentially free of asphaltenes and an asphaltene-rich stream; (3) feeding a third process stream comprising the resin stream to a delayed coker; (4) heating the third process stream in the delayed coker under delayed coking conditions to form a batch of the anode grade coke. The second process stream can further comprise a portion, preferably a minor portion, of the residue feedstock free of hydrotreating. The third process stream can include a portion, preferably a minor portion, of the deasphalted oil and/or a portion, preferably a minor portion, of the asphaltene-rich stream. At least a portion of the asphaltene-rich stream can be blended with cutterstock to form a low sulfur fuel oil stream.

The present invention also has applicability when the deasphalted oil stream comprises resin, for example when no separate resin stream is produced. In one embodiment wherein the deasphalted oil stream contains resin, the present invention provides a process for preparing anode grade coke from a petroleum residue feedstock containing sulfur and metal contaminants, comprising: (1) hydrotreating a first process stream consisting essentially of the residue feedstock to produce a hydrotreated residue stream of reduced sulfur and metal content; (2) solvent deasphalting a second process stream comprising the hydrotreated residue stream to produce a deasphalted oil stream comprising resin and an asphaltene-rich stream; (3) feeding a third process stream comprising the deasphalted oil stream to a delayed coker; and (4) heating the third process stream in the delayed coker under delayed coking conditions to form a batch of the anode grade coke. The second process stream can further comprise a portion of the residue feedstock free of hydrotreating. The third process stream can further comprise a minor portion of the asphaltene-rich stream. The process can further comprise blending at least a portion of the asphaltene-rich stream with cutterstock to form a low sulfur fuel oil stream.

In another embodiment wherein the deasphalted oil stream comprises resin, the process for preparing anode grade coke from a petroleum residue feedstock containing sulfur and metal contaminants comprises: (1) hydrotreating a first process stream consisting essentially of a first portion of the residue feedstock to produce a hydrotreated residue stream of reduced sulfur and metal content; (2) solvent deasphalting a second portion of the residue feedstock to produce a deasphalted oil stream comprising resin and an asphaltene-rich stream; (3) feeding the hydrotreated residue stream together with a second process stream comprising the deasphalted oil stream to a delayed coker; and (4) heating the hydrotreated residue stream and the second process stream in the delayed coker under delayed coking conditions to form a batch of the anode grade coke. The second process stream can further comprise a minor portion of the asphaltene-rich stream. Between batches of anode grade coke formation, a third process stream consisting essentially of the asphaltene-rich stream can be fed to the delayed coker and heated in the delayed coker under delayed coking conditions to form a batch of fuel grade coke. A portion of the asphaltene-rich stream can be blended with cutterstock to form a fuel oil stream.

In another embodiment wherein the deasphalted oil stream comprises resin, the process for preparing anode grade coke from a petroleum residue feedstock containing sulfur and metal contaminants comprises: (1) solvent deasphalting a first process stream consisting essentially of the residue feedstock to produce a deasphalted oil stream comprising resin and an asphaltene-rich stream; (2) hydrotreating a second process stream consisting essentially of the deasphalted oil stream to produce a hydrotreated residue stream of reduced sulfur and metal content; (3) feeding a third process stream comprising the hydrotreated residue stream to a delayed coker; and (4) heating the third process stream in the delayed coker under delayed coking conditions to form a batch of the anode grade coke. The process can further comprise blending at least a portion of the asphaltene-rich stream with cutterstock to form a high sulfur fuel oil stream and/or blending at least a portion of the hydrotreated residue stream with cutterstock to form a low sulfur fuel oil stream.

DETAILED DESCRIPTION OF THE INVENTION

Figure 1:
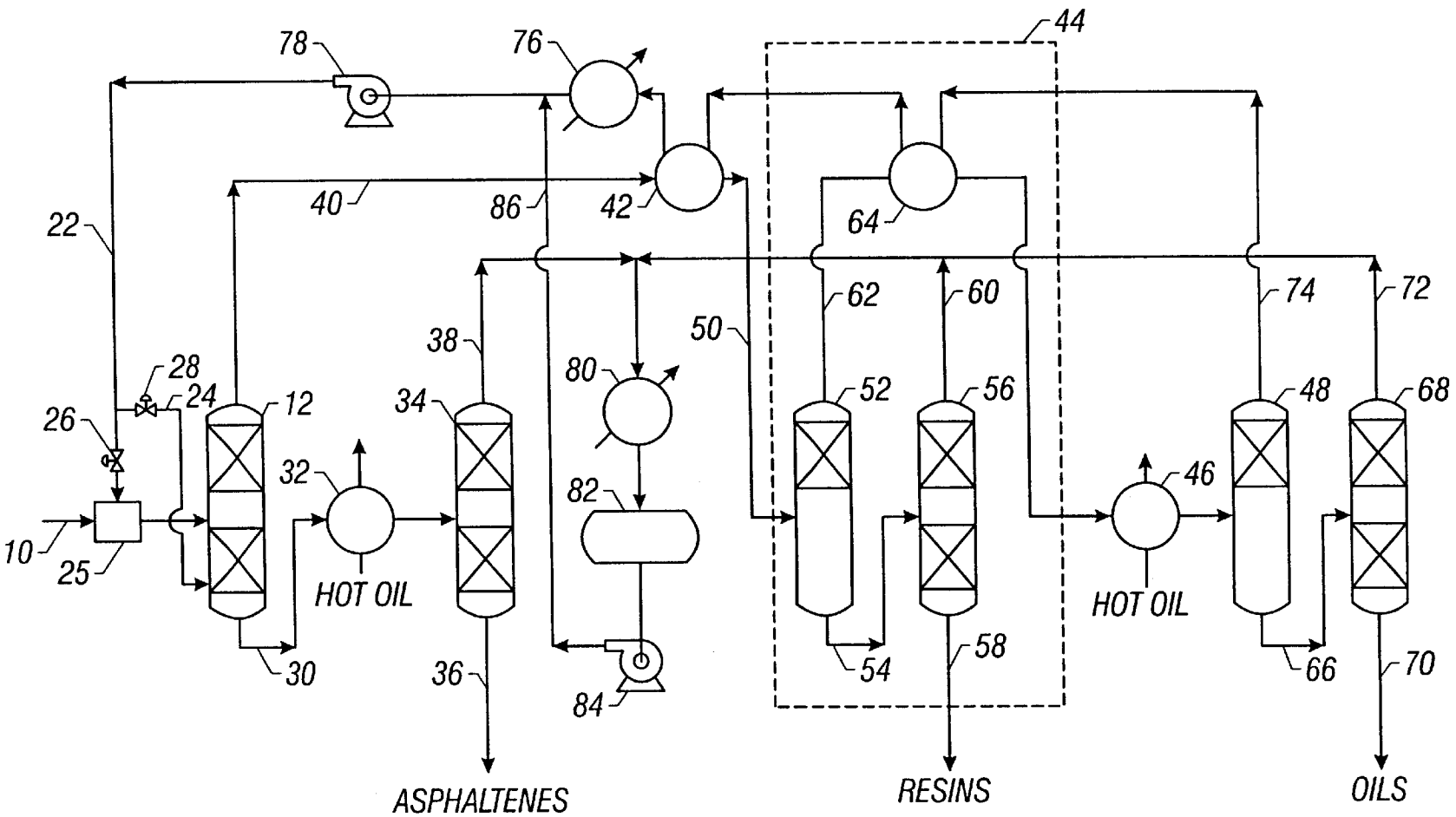
FIG. 1 is a schematic illustration of a typical solvent deasphalting process according to the principles of the present invention.

As used in the specification and claims, anode grade coke is petroleum coke which has a sulfur content of less than 3 weight percent, a total metals content of less than 500 ppm, a nickel content of less than 200 ppm, a vanadium content less than 350 ppm, a bulk density of at least 50 lbs/ft$^3$, an Hardgrove grindability index (HGI) greater than 70, and a volatile carbonaceous matter (VCM) content of less than 10–12 weight percent. Fuel grade coke is coke which does not meet one or more of the specifications required for anode grade coke.

As used in the present specification and claims, a petroleum residue is the residue remaining after atmospheric tower or vacuum tower distillation of petroleum. "Long residue" generally refers to atmospheric bottoms. "Short residue" generally refers to vacuum tower bottoms. The present invention is generally applicable to making anode grade coke from any petroleum residue feedstock, and particularly well suited to making anode grade coke from residues having a high sulfur and/or metal content.

"Solvent extraction" as used in the present specification and claims generally refers to the extraction of a deasphalted oil (DAO) from a petroleum residue and/or hydrotreated petroleum residue with a light hydrocarbon solvent or solvent blend with components such as propane, butane, pentane or the like. Asphaltenes are rejected from the process as a byproduct. If desired, a resin-rich fraction can be separated from the DAO. The deasphalted oil is generally processed as an incremental feedstock to downstream refinery units such as hydrocrackers to produce more valuable light-boiling products. The asphaltene product can be used as fuel, as a blending component in heavy fuel oil or emulsions, as a blend component in some grades of asphalt cement and/or subject to further processing such as coking, visbreaking or partial oxidation to recover additional products. According to the present invention, it is particularly preferred to use supercritical solvent extraction, although subcritical solvent extraction could also be used if efficiency is not as important.

"Hydrotreating" as used in the present specification and claims refers to the treatment of a petroleum residue or similar feedstock with hydrogen at a partial pressure typically greater than 800 psi in the presence of a hydrotreating catalyst at a temperature typically above 500° F. to obtain moderate or deep desulfurization. Hydrotreating generally produces a product of reduced sulfur and metals content which contains lower-boiling materials such as light hydrocarbon gases, naphtha, distillate, light gas oil, light vacuum gas oil, heavy vacuum gas oil and a hydrotreated vacuum residue which are separated from the hydrotreater effluent using conventional equipment and methodology. "Hydrotreated residue" or "hydrotreated resin" refers to the vacuum tower bottoms from the separation of the hydrotreating unit effluent wherein the feed to the hydrotreater is petroleum residue or resin, respectively.

"Delayed coking" generally refers to the destructive thermal cracking of a petroleum residue with the recovery of lower-boiling hydrocarbons and the formation of petroleum coke in the delayed coking vessel. The petroleum coke can be fuel grade coke or the relatively more valuable anode grade coke. We prefer to use a resin-rich feedstock to facilitate the formation of anode grade coke.

A typical solvent deasphalting process useful in the present invention is illustrated schematically in FIG. 1. A petroleum residue such as, for example, a reduced crude is supplied via line 10 to asphaltene separator 12. Solvent is introduced via lines 22 and 24 into mixer 25 in line 10 and asphaltene separator 12, respectively. If desired, all or part of the solvent can be introduced into the feed line 10 via line 22 as mentioned previously. Valves 26 and 28 are provided for controlling the rate of addition of the solvent into asphaltene separator 12 and line 10, respectively. If desired, a conventional mixing element 25 can be employed in line 10 to mix in the solvent introduced from line 22.

The asphaltene separator 12 contains conventional contacting elements such as bubble trays, packing elements such as rings or saddles, structural packing such as that available under the trade designation ROSEMAX, or the like. In the asphaltene separator, the reduced crude separates into a solvent/deasphalted oil (DAO) phase, or if resin recovery is employed as discussed in more detail below, a solvent/resin/DAO phase, and an asphaltene phase. The solvent/DAO or solvent/resin/DAO phase passes upwardly while the heavier asphaltene phase travels downwardly through separator 12. As asphaltene solids are formed, they are heavier than the solvent/DAO or solvent/resin/DAO phase and pass downwardly. The asphaltene phase is collected from the bottom of the asphaltene separator 12 via line 30, heated in heat exchanger 32 and fed to flash tower 34. The asphaltene phase is stripped of solvent in flash tower 34. The asphaltene is recovered as a bottoms product in line 36, and solvent vapor overhead in line 38.

The asphaltene separator 12 is maintained at an elevated temperature and pressure sufficient to effect a separation of the petroleum residuum and solvent mixture into a solvent/DAO or, if the optional resin recovery section 44 is utilized, a solvent/resin/DAO phase and an asphaltene phase. Typically, asphaltene separator 12 is maintained at a temperature level in the range of from about 100° F. to above the critical temperature of the solvent and a pressure level at least equal to the vapor pressure of the solvent when at a temperature below the critical temperature of the solvent and at least equal to the critical pressure of the solvent when at a temperature equal to or above critical temperature of the solvent. In another embodiment, the temperature level is maintained within the range of from the critical temperature of the solvent to 50° F. above the critical temperature of the solvent. In this embodiment, the pressure level preferably is maintained above the critical pressure of the solvent.

The solvent/DAO or solvent/resin/DAO phase is collected overhead from the asphaltene separator 12 via line 40 and conventionally heated via heat exchanger 42. If the optional resin recovery section 44 is not employed, the heated solvent/DAO phase is supplied directly to heat exchanger 46 and DAO separator 48; otherwise the solvent/DAO phase is supplied via line 50 to resin separator 52. As is known in the art, the temperature of the solvent/DAO phase leaving exchanger 46 will depend on whether or not the resin recovery section 44 is employed. Generally, the solvent/DAO phase is only partially heated in exchanger 42 so as to selectively form an equilibrium solvent/resin phase which is separated from the remaining solvent/DAO phase. The resin separator 52 is maintained at an elevated temperature and pressure sufficient to effect a separation of the solvent/resin/DAO into solvent/resin phase and a solvent/DAO phase. In the resin separator 52, the heavier resin/solvent phase passes downwardly while the lighter remaining solvent/DAO phase passes upwardly. The resin/solvent phase is collected from the bottom of the resin separator 52 via line 54. The resin phase is fed to flash tower 56 which yields resins via bottoms line 58 and solvent vapor overhead via line 60. The overhead solvent/DAO phase from resin separator 52 is passed via line 62 through heat exchangers 64 and 46 into DAO separator 48.

The resin separator 52 is maintained at a temperature level above that in the asphaltene separator 12. The pressure level in resin separator 52 is maintained at least equal to the vapor pressure of the solvent when separator 52 is maintained at a temperature below the critical temperature of the solvent and at least equal to the critical pressure of the solvent when maintained at a temperature equal to or above the critical temperature of the solvent. Preferably, the temperature level is maintained at a temperature in the range of from 5° F. to 100° F. above the temperature in asphaltene separator 12 or from 5° F. to 50° F. above the critical temperature of the solvent. The pressure level in resin separator 52 can be substantially the same pressure level as maintained in asphaltene separator 12.

As is well known, the temperature and pressure of the solvent/DAO phase is manipulated to cause a DAO phase to separate from a solvent phase. The DAO separator 48 is maintained at an elevated temperature and pressure sufficient to effect a separation of the solvent/DAO mixture into solvent and DAO phases. In the DAO separator 48, the heavier DAO phase passes downwardly while the lighter solvent phase passes upwardly. The DAO phase is collected from the bottom of the DAO separator 48 via line 66. The DAO phase is fed to flash tower 68 where it is stripped to obtain a DAO product via bottoms line 70 and solvent vapor in overhead line 72. Solvent is recovered overhead from DAO separator 48 via line 74, and cooled in heat exchangers 64, 42 and 76 for recirculation via pump 78 and lines 22, 24. Solvent recovered from vapor lines 38, 60 and 72 is condensed in heat exchanger 80, accumulated in surge drum 82 and recirculated via pump 84 and line 86.

The DAO separator 48 typically is maintained at a temperature higher than the temperature in either the asphaltene separator 12 or the resin separator 52. The pressure level in DAO separator 48 is maintained at least equal to the critical pressure of the solvent when maintained at a temperature equal to or above the critical temperature of the solvent. Particularly, the temperature level in DAO separator 48 is maintained above the critical temperature of the solvent and most particularly at least 50° F. above the critical temperature of the solvent.

In the delayed coker used in the process of the present invention, the coking process is essentially a severe thermal cracking process except that the temperature is not generally high enough to rupture the carbon-carbon bonds in the aromatic nuclei. Decomposition does occur, however, in the nonaromatic oils and between paraffinic sidechains and linkages in the aromatic oils. As the alkyl radicals form, many of them extract hydrogen from the aromatics and any asphaltenes. The high molecular weight aromatic and asphaltene radicals then react with each other to form larger molecules.

Figure 2:
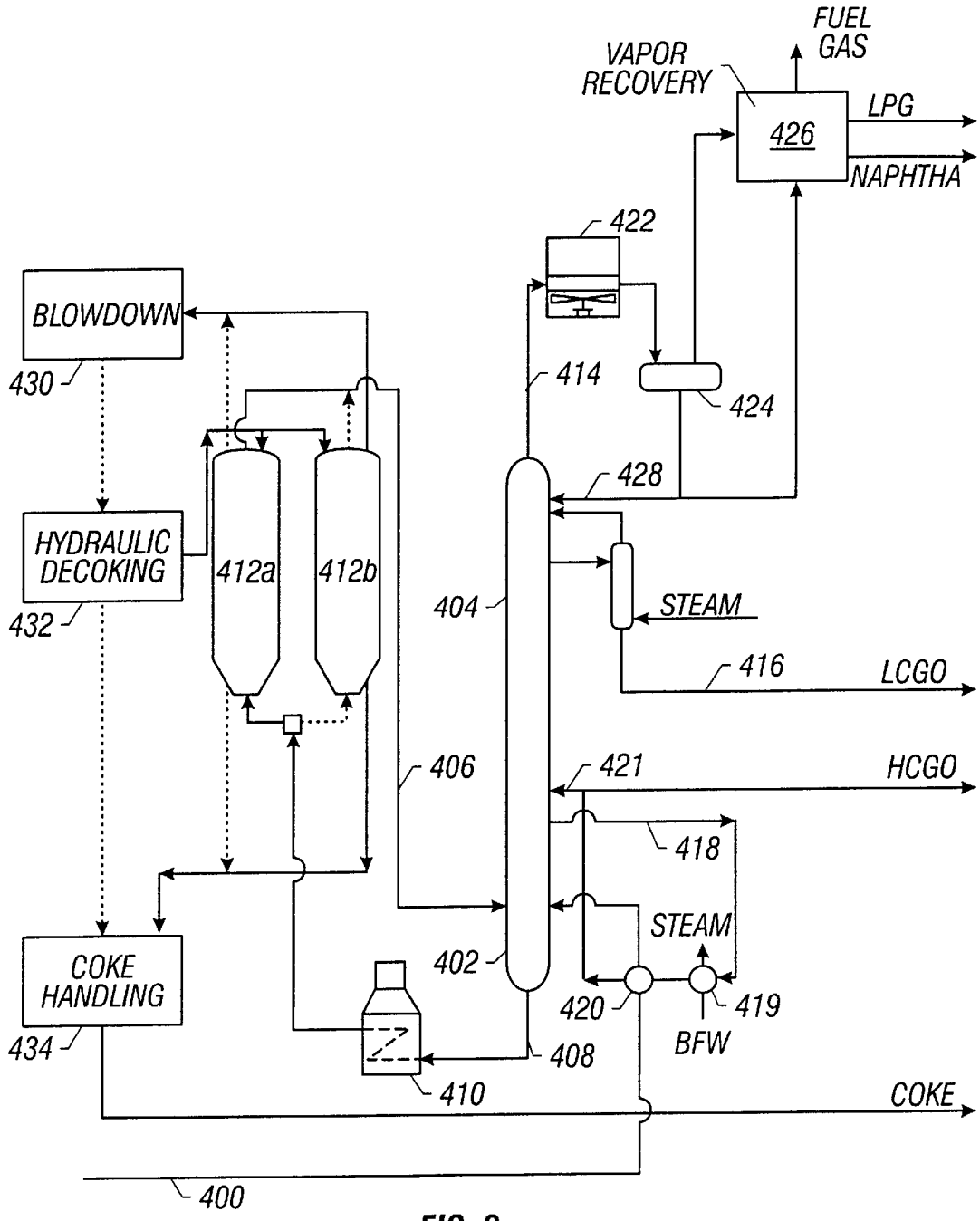
FIG. 2 is a schematic illustration of a typical delayed coking process according to the principles of the present invention.

By these mechanisms a large portion of the aromatic nuclei contained in the coker feed 400 (see FIG. 2) polymerize to form the solid coke product. Lighter materials are vaporized and eventually condense in the coker fractionator 404 and form coker vapor and liquid products. The only aromatics in the liquid products are those contained in molecules that are small enough to vaporize at coking conditions. The gasoline and light coker gas oil produced in delayed coking are predominantly paraffinic and olefinic.

Residue-containing feed stream 400 is fed at about 600° F. to the bottom section 402 of the coker fractionator 404 where it is mixed with heavy coker gas oil recycle. The fresh feed plus the recycle is sent to the coker furnace 410 and heated to around 915° F.–930° F. to initiate the coking reaction. Effluent from the coker furnace 410 flows to the onstream coke drum 412*a* where the coke is deposited. The other drum 412*b* is offstream for coke removal. Vapor from the onstream drum 412*a* is returned to the fractionator 404 via line 406 where it is separated into overhead vapor stream 414, light coker gas oil (LCGO) stream 416 and heavy coker gas oil (HCGO) stream 418. The HCGO stream 418 is cooled in heat exchangers 419,420 and part of the cooled stream 418 is recycled via line 421 to the coker fractionator 404. The overhead vapor stream is cooled in air exchanger 422 and separated into vapor and liquid components in accumulator 424 which are fed to conventional vapor recovery unit 426 for separation into fuel gas, optional liquid petroleum gas and naphtha. Part of the liquid from the accumulator 424 is refluxed via line 428 to the top of the fractionator 404.

When the onstream coke drum 412*a* is nearly filled to the top, or after a predetermined period of time, the coker furnace 410 effluent is directed to the empty coke drum 412*b* (previously offstream). The full coke drum 412*a* is purged with steam to remove volatile hydrocarbons, cooled by filling with water, opened and drained, as is conventional in the art. Water from this operation is typically reclaimed in blowdown system 430. The blowdown system 430, hydraulic decoking system 432 and coke handling system 434 all work together to manage the batch process of coke production as is well known in the art. For example, the decoking operation is typically done with a hydraulic jet system utilizing high pressure water jets positioned on a rotating drill stem to mechanically cut the coke from the coke drum 412*a*. Coke which falls from the drum 412*a* can be collected directly in a rail car, sluiced and pumped as a water slurry or moved with front end loaders.

Figure 3:
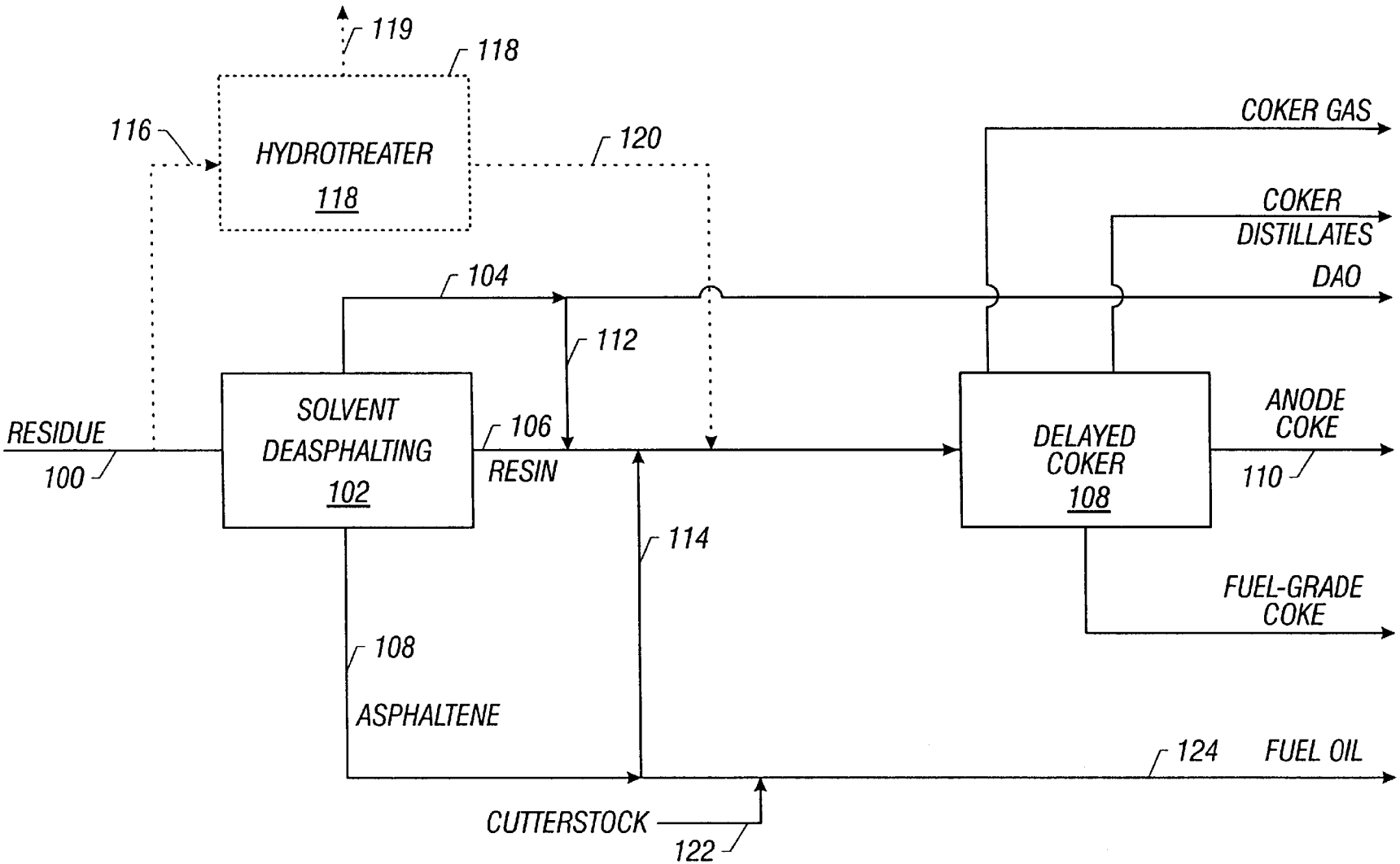
FIG. 3 is a block flow diagram according to one embodiment of the invention wherein petroleum residue is subject to solvent deasphalting and optional hydrotreating in parallel with feed of the effluents including the resin-containing stream from the solvent deasphalting unit to a delayed coker for the formation of anode grade coke.

With reference to FIG. 3 a petroleum residue feedstock stream is fed to solvent deasphalting unit 102 where it is separated into DAO stream 104, resin stream 106 and asphaltene stream 108. The resin stream 106 is fed to the delayed coker 108 to produce a batch of anode coke 110. If desired, minor portions of the DAO stream 104 and asphaltene stream 108 may be fed to the delayed coker with the resin stream 106 via lines 112 and 114 respectively. Alternatively, all or part of the asphaltene stream 108 may be fed to the delayed coker to make batches of fuel grade coke between batches of anode grade coke production.

In the configuration of FIG. 3, it is also possible to divert a portion of the residue feedstock stream 100 through line 116 to hydrotreater 118 to produce lighter products 119 and a hydrotreated residue stream 120 which may be supplied to the delayed coker along with resin stream 106 to produce anode grade coke and/or fuel grade coke.

Also, if desired, the asphaltene stream 108 can be blended with cutter stock via line 122 to produce fuel oil stream 124.

The embodiment of FIG. 3 is particularly desirable for treating petroleum residues having a relatively small proportion of asphaltenes. For anode grade coke, asphaltenes should preferably comprise less than 30% of the feed to the delayed coker. High asphaltene contents can result in undesirable plugging of the coker heater. In general, the DAO and resin feeds limit the metals content fed to the delayed coker, while some hydrotreated feed (without separation of asphaltenes) can be tolerated provided that the bulk density of the anode grade coke remains above about 50 lbs/ft$^3$.

Figure 4:
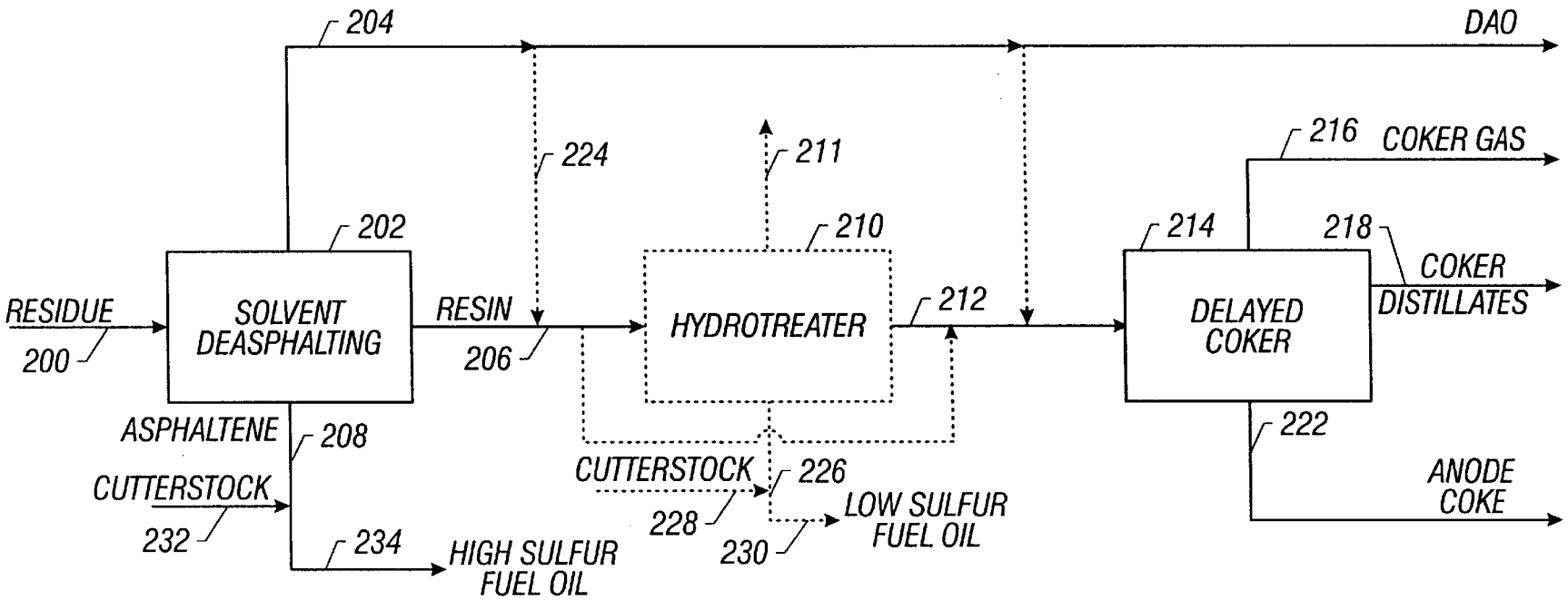
FIG. 4 is a block flow diagram according to another embodiment of the present invention wherein residue is subject to solvent deasphalting and the resin fraction obtained thereby is optionally hydrotreated before being supplied to a delayed coker to make anode grade coke.

In the embodiment illustrated in FIG. 4, the petroleum residue feedstock stream 200 is fed to solvent deasphalting unit 202 to obtain a DAO stream 204, a resin stream 206 and an asphaltene stream 208. The resin stream 208 is optionally fed to hydrotreater 210 to obtain lighter products 211 and a hydrotreated resin stream 212 which is fed to delayed coker 214 to obtain a coker gas stream 216 and a substantial quantity of a coker distillates stream 218 while making anode grade coke in batch stream 222.

If desired, a minor portion of the DAO stream 204 can be diverted through line 224 for hydrotreatment with the resin stream 206. The hydrotreated resin and/or DAO product can also be diverted through line 226 for blending with cutter stock via line 228 to obtain a low sulfur fuel oil stream 230.

Also, if desired, the asphaltene stream 208 can be blended with cutterstock via line 232 to form a high sulfur fuel oil stream 234.

Figure 5:
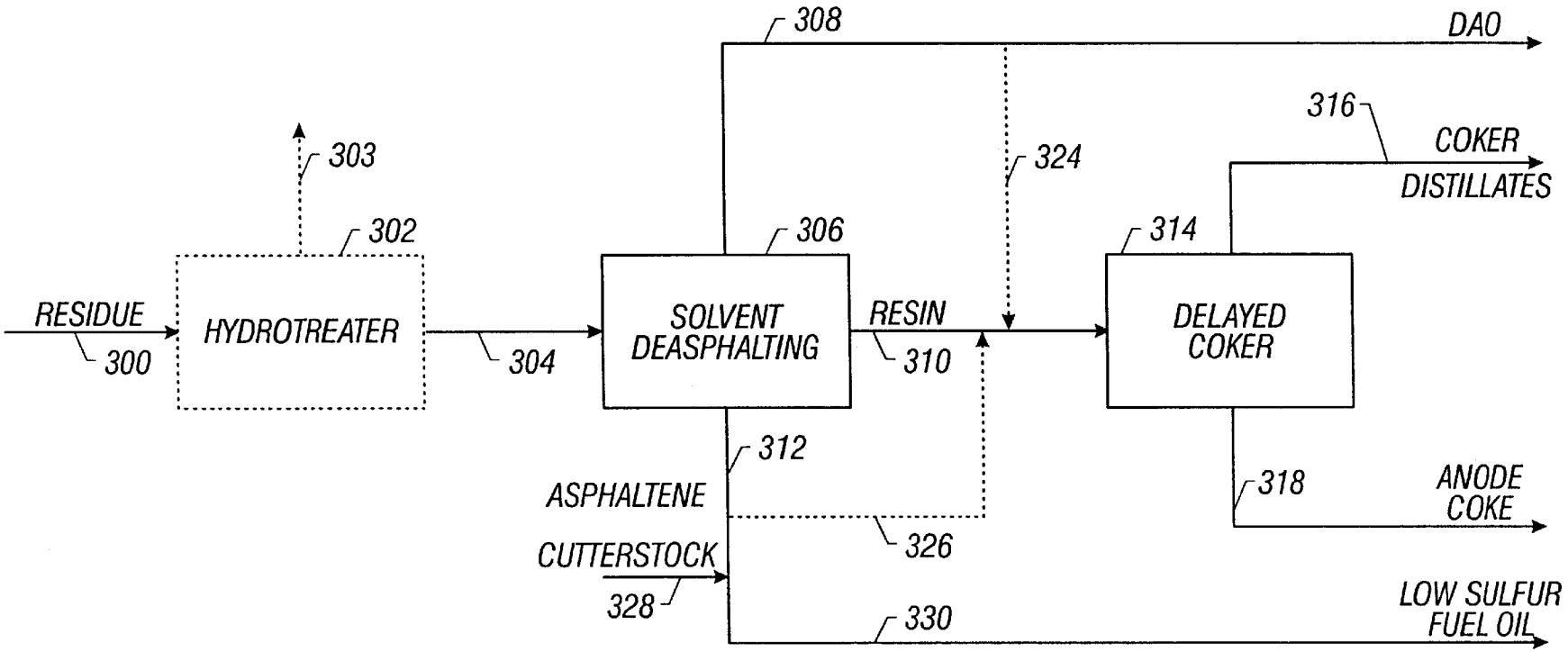
FIG. 5 is a block flow diagram according to another embodiment of the present invention wherein residue is subject to hydrotreating, and the hydrotreated residue is fed to a solvent deasphalting unit and a resin-containing stream from the solvent deasphalting unit is fed to a delayed coker to make anode grade coke.

In the embodiment of FIG. 5, the petroleum residue feedstock stream 300 is fed to optional hydrotreater 302 to obtain lighter products 303 and a hydrotreated residue stream 304 which is in turn supplied to solvent deasphalting unit 306 to obtain DAO stream 308, resin stream 310 and asphaltene stream 312. The resin stream 310 is fed to delayed coker 314 to obtain a coker distillates stream 316 and anode grade coke in batch stream 318. If desired, a minor portion of the DAO and/or asphaltene can be diverted via lines 324 and/or 326, respectively, for feed to the delayed coker 314 with resin stream 310. The asphaltene can also be blended with cutterstock stream 328 to obtain a low sulfur fuel oil stream 330.

EXAMPLE 1

A vacuum residue feedstock with a relatively low sulfur content is solvent deasphalted to obtain a DAO/resin stream which is processed in a delayed coker. (Alternatively, the solvent deasphalting produces separate DAO and resin streams which are fed together to the delayed coker.) The process scheme corresponds to that shown in FIG. 3 without any hydrotreating and feed of the entire quantity of the combined DAO and resin streams to the delayed coker. The solvent deasphalting unit is operated with isobutane as a solvent, a solvent-to-residue volume ratio of 8:1, a temperature of 100–350° F. and a pressure of 500–700 psig. The coker is operated at 800–900° F. and 15–30 psig and a throughput ratio of 1–2. The relative quantities and properties of the residue feed, the feed to the coker, the asphaltene-rich stream from the solvent deasphalting unit and the coke are presented in Table 2.

TABLE 2

| | Residue feed (stream 100) | DAO + resin (streams 106 and 112) | Asphaltene (stream 108) | Anode coke (stream 110) |
|---|---|---|---|---|
| Yield, wt % | 100 | 73 | 27 | 18 |
| Gravity, °API | 5.5 | 9.9 | 8.9 | — |
| Sulfur, wt % | 2.2 | 1.8 | 3.3 | 3.0 |
| Conradson carbon, wt % | 22 | 13 | 52 | — |
| Nickel, ppmw | 55 | 16 | 172 | 66 |
| Vanadium, ppmw | 129 | 32 | 450 | 132 |

The coke has HGI greater than 70 and a bulk density greater than 50 lb/ft$^3$.

EXAMPLE 2

A vacuum residue with a relatively high sulfur content is processed in a solvent deasphalting unit to obtain a DAO/resin stream which is hydrotreated to obtain a hydrotreated residue stream which is fed to a is delayed coker. (Alternatively, the solvent deasphalting unit produces separate DAO and resin streams which are fed together to the hydrotreater.) The process scheme corresponds to that in FIG. 4 with feed of the entire quantity of the combined DAO and resin streams to the hydrotreater without any hydrotreater bypass. The solvent deasphalting unit is operated with isobutane as the solvent, a solvent-to-residue volume ratio of 8:1, a temperature of 100–350° F., and a pressure of 500–700 psig. The hydrotreater is operated at a hydrogen partial pressure of 600–800 psig, a temperature of 600–700° F. and 50% desulfurization. The delayed coker is operated as in Example 1. The relative quantities and properties of the residue feed, the DAO/resin feed to the hydrotreater, the asphaltene-rich stream, the coker feed and the coke are presented in Table 3.

TABLE 3

| | Residue feed (stream 200) | DAO + resin (streams 206 and 224) | Asphaltene (stream 208) | Coker feed (stream 212) | Anode coke (stream 222) |
|---|---|---|---|---|---|
| Yield, wt % | 100 | 80 | 20 | 78 | 15 |
| Gravity, °API | 6.9 | 11.1 | 8.9–9.6 | 13 | — |
| Sulfur, wt % | 4.0 | 3.3 | 3.36.8 | 1.6 | 2.7 |

TABLE 3-continued

| | Residue feed (stream 200) | DAO + resin (streams 206 and 224) | Asphaltene (stream 208) | Coker feed (stream 212) | Anode coke (stream 222) |
|---|---|---|---|---|---|
| Conradson carbon, wt % | 21 | 11 | 60 | 10 | — |
| Nickel, ppmw | 23 | 3 | 90 | 4 | 22 |
| Vanadium, ppmw | 75 | 12 | 300 | 13 | 70 |

The coke has HGI greater than 70 and a bulk density greater than 50 lb/ft$^3$.

EXAMPLE 3

A vacuum residue with a relatively high sulfur content is processed in a hydrotreater to obtain a hydrotreated residue which is fed to a solvent deasphalting unit to obtain a resin stream for feed to a delayed coker. The process scheme corresponds to FIG. 5. The hydrotreater is operated at a hydrogen partial pressure of 2900 psig, a temperature of 800–900° F. and 65% conversion to lighter products. The solvent deasphalting unit is operated with isobutane as the solvent, a solvent-to-residue volume ratio of 8:1, a temperature of 100–350° F., and a pressure of 500–700 psig. The delayed coker is operated as in Example 1. The relative quantities and properties of the residue feed, the hydrotreated residue, DAO, resin, asphaltene and anode grade coke are presented in Table 4.

TABLE 4

| | Residue feed (stream 300) | Hydrotreated residue (stream 304) | DAO (stream 308) | Asphaltene (stream 312) | Resin (stream 310) | Anode coke (stream 318) |
|---|---|---|---|---|---|---|
| Yield, wt % | 100 | 35 | 12.2 | 13.0 | 9.8 | 3 |
| Gravity,°API | 4.4 | 4.4 | 16.2 | −9.3 | 7.6 | — |
| Sulfur, wt % | 5.0 | 2.2 | 1.4 | 3.2 | 1.8 | 3.0 |
| Conradson carbon, wt % | 29 | 25.8 | 4.5 | 53.1 | 16.3 | — |
| Nickel, ppmw | 50 | 42 | <1 | 116 | 6 | 19 |
| Vanadium, ppmw | 97 | 84 | <1 | 222 | 7 | 23 |

The coke has HGI greater than 70 and a bulk density greater than 50 lb/ft$^3$.

What is claimed is:

1. A process for preparing anode grade coke from a petroleum residue feedstock containing sulfur and metal contaminants and essentially free of hydrotreated material, comprising:

solvent deasphalting the residue feedstock to produce a deasphalted oil stream, a resin stream essentially free of asphaltenes and an asphaltene-rich stream;

feeding a process stream comprising the resin stream and essentially free of hydrotreated material directly to a delayed coker;

heating the process stream in the delayed coker under delayed coking conditions to form a batch of the anode grade coke.

2. A process for preparing anode grade coke from a petroleum residue feedstock containing sulfur and metal contaminants and essentially free of hydrotreated material, comprising:

solvent deasphalting the residue feedstock to produce a deasphalted oil stream comprising resin and an asphaltene-rich stream;

feeding a process stream comprising the deasphalted oil stream and essentially free of hydrotreated material directly to a delayed coker;

heating the process stream in the delayed coke under delayed coking conditions to form a batch of the anode grade coke.

3. A process for preparing anode grade coke from a petroleum residue feedstock containing sulfur and metal contaminants, comprising:

hydrotreating a first process stream consisting essentially of a first minor portion of the residue feedstock to produce a hydrotreated residue stream of reduced sulfur and metal content;

solvent deasphalting a second major portion of the residue feedstock to produce a deasphalted oil stream, a resin stream essentially free of asphaltenes and an asphaltene-rich stream;

feeding the hydrotreated residue stream together with a second process stream comprising the resin stream and essentially free of hydrotreated material to a delayed coker;

heating the hydrotreated residue stream and the second process stream in the delayed coker under delayed coking conditions to form a batch of the anode grade coke.

4. The process of claim 3 wherein the second process stream further comprises in a minor proportion a portion of the deasphalted oil stream.

5. The process of claim 3 wherein the second process stream further comprises in a minor proportion a portion of the asphaltene-rich stream.

6. The process of claim 4 wherein the second process stream further comprises in a minor proportion a portion of the asphaltene-rich stream.

7. The process of claim 3 further comprising, between batches of anode grade coke formation, feeding a third process stream consisting essentially of the asphaltene-rich stream to the delayed coker and heating the third process stream in the delayed coker under delayed coking conditions to form a batch of fuel grade coke.

8. The process of claim 3 further comprising blending at least a portion of the asphaltene-rich stream with cutterstock to form a fuel oil stream.

9. A process for preparing anode grade coke from a petroleum residue feedstock containing sulfur and metal contaminants and essentially free of hydrotreated material, comprising:

solvent deasphalting a first process stream consisting essentially of the residue feedstock to produce a deasphalted oil stream, a resin stream essentially free of asphaltenes and an asphaltene-rich stream;

hydrotreating a second process stream consisting essentially of the resin stream to produce a hydrotreated resin-containing stream of reduced sulfur and metal content;

feeding a third process stream comprising the hydrotreated resin-containing stream to a delayed coker;

heating the third process stream in the delayed coker under delayed coking conditions to form a batch of the anode grade coke.

10. The process of claim 9 wherein the third process stream further comprises a portion of the resin stream free of hydrotreating.

11. The process of claim 9 further comprising blending at least a portion of the asphaltene-rich stream with cutterstock to form fuel oil.

12. The process of claim 9 further comprising blending at least a portion of the hydrotreated resin-containing stream with cutterstock to form a low sulfur fuel oil stream.

13. A process for preparing anode grade coke from a petroleum residue feedstock containing sulfur and metal contaminants and essentially free of hydrotreated material, comprising:

solvent deasphalting a first process stream consisting essentially of the residue feedstock to produce a deasphalted oil stream, a resin stream essentially free of asphaltenes and an asphaltene-rich stream;

hydrotreating a second process stream consisting essentially of the resin stream and a minor portion of the deasphalted oil stream to produce a hydrotreated resin-containing stream of reduced sulfur and metal content;

feeding a third process stream comprising the hydrotreated resin-containing stream to a delayed coker;

heating the third process stream in the delayed coker under delayed coking conditions to form a batch of the anode grade coke.

14. The process of claim 13 wherein the third process stream further comprises a portion of the resin stream free of hydrotreating.

15. The process of claim 13 further comprising blending at least a portion of the asphaltene-rich stream with cutterstock to form fuel oil.

16. The process of claim 13 further comprising blending at least a portion of the hydrotreated resin-containing stream with cutterstock to form a low sulfur fuel oil stream.

17. A process for preparing anode grade coke from a petroleum residue feedstock containing sulfur and metal contaminants and essentially free of hydrotreated material, comprising:

hydrotreating a first process stream consisting essentially of a major portion of the residue feedstock to produce a hydrotreated residue stream of reduced sulfur and metal content;

solvent deasphalting a second process stream comprising the hydrotreated residue stream and a minor portion of the residue feedstock essentially free of hydrotreating to produce a deasphalted oil stream, a resin stream essentially free of asphaltenes and an asphaltene-rich stream;

feeding a third process stream comprising the resin stream to a delayed coker;

heating the third process stream in the delayed coker under delayed coking conditions to form a batch of the anode grade coke.

18. The process of claim 17 wherein the third process stream further comprises a portion of the deasphalted oil stream.

19. The process of claim 17 wherein the third process stream further comprises a portion of the asphaltene-rich stream.

20. The process of claim 18 wherein the third process stream further comprises a portion of the asphaltene-rich stream.

21. The process of claim 17 further comprising blending at least a portion of the asphaltene-rich stream with cutterstock to form a low sulfur fuel oil stream.

22. A process for preparing anode grade coke from a petroleum residue feedstock containing sulfur and metal contaminants and essentially free of hydrotreated material, comprising:

hydrotreating a first process stream consisting essentially of a major portion of the residue feedstock to produce a hydrotreated residue stream of reduced sulfur and metal content;

solvent deasphalting a second process stream comprising the hydrotreated residue stream and a minor portion of the residue feedstock to produce a deasphalted oil stream comprising resin and an asphaltene-rich stream;

feeding a third process stream comprising the deasphalted oil stream to a delayed coker;

heating the third process stream in the delayed coker under delayed coking conditions to form a batch of the anode grade coke.

23. The process of claim 22 wherein the third process stream further comprises a portion of the asphaltene-rich stream.

24. The process of claim 22 further comprising blending at least a portion of the asphaltene-rich stream with cutterstock to form a low sulfur fuel oil stream.

25. A process for preparing anode grade coke from a petroleum residue feedstock containing sulfur and metal contaminants and essentially free of hydrotreated material, comprising:

hydrotreating a first process stream consisting essentially of a minor portion of the residue feedstock to produce a hydrotreated residue stream of reduced sulfur and metal content;

solvent deasphalting a major portion of the residue feedstock to produce a deasphalted oil stream comprising resin and an asphaltene-rich stream;

feeding the hydrotreated residue stream together with a second process stream comprising the deasphalted oil stream to a delayed coker;

heating the hydrotreated residue stream and the second process stream in the delayed coker under delayed coking conditions to form a batch of the anode grade coke.

26. The process of claim 25 wherein the second process stream further comprises a portion of the asphaltene-rich stream.

27. The process of claim 25 further comprising, between batches of anode grade coke formation, feeding a third process stream consisting essentially of the asphaltene-rich stream to the delayed coker and heating the third process stream in the delayed coker under delayed coking conditions to form a batch of fuel grade coke.

28. The process of claim 25 further comprising blending at least a portion of the asphaltene-rich stream with cutterstock to form a fuel oil stream.

29. A process for preparing anode grade coke from a petroleum residue feedstock containing sulfur and metal contaminants and essentially free of hydrotreated material, comprising:

solvent deasphalting a first process stream consisting essentially of the residue feedstock to produce a deasphalted oil stream comprising resin and an asphaltene-rich stream;

hydrotreating a second process stream consisting essentially of the deasphalted oil stream to produce a hydrotreated residue stream of reduced sulfur and metal content;

feeding a third process stream comprising the hydrotreated residue stream to a delayed coker;

heating the third process stream in the delayed coker under delayed coking conditions to form a batch of the anode grade coke.

30. The process of claim 29 further comprising blending at least a portion of the asphaltene-rich stream with cutterstock to form a high sulfur fuel oil stream.

31. The process of claim 29 further comprising blending at least a portion of the hydrotreated residue stream with cutterstock to form a low sulfur fuel oil stream.

* * * * *